United States Patent [19]

Herota

[11] Patent Number: 4,566,356

[45] Date of Patent: Jan. 28, 1986

[54] RATCHET WRENCH ASSEMBLY

[75] Inventor: Rosh N. Herota, Yuba City, Calif.

[73] Assignees: Tom Tateyama; K & H Distributors, both of Woodland, Calif.

[21] Appl. No.: 617,492

[22] Filed: Jun. 5, 1984

[51] Int. Cl.[4] ..... B25B 13/46

[52] U.S. Cl. ..... 81/62

[58] Field of Search ..... 81/60–63.3; 192/43–45

[56] References Cited

U.S. PATENT DOCUMENTS

| | | | |
|---|---|---|---|
| 768,220 | 8/1904 | Gracey | 81/63 |
| 3,608,402 | 9/1971 | Rainey | 81/63.1 |
| 4,277,989 | 7/1981 | Tracy | 81/62 |
| 4,300,413 | 11/1981 | Garofalo | 81/62 |
| 4,308,769 | 1/1982 | Rantanen | 81/63 |
| 4,445,404 | 5/1984 | Parker | 81/62 |
| 4,475,420 | 10/1984 | Atkinson et al. | 81/63 X |

*Primary Examiner*—Frederick R. Schmidt
*Assistant Examiner*—Debra S. Meislin
*Attorney, Agent, or Firm*—Lothrop & West

[57] ABSTRACT

A ratchet wrench in which the mechanism determining the operative mode is remotely controlled from the grip, or handle end of the wrench. A rod, supported for reciprocating translation along the shank of the wrench, is pivotally interconnected to a radial portion of the reverse control knob of a conventional ratchet. The rod extends to the handle end of the wrench, where it is terminated by a tab, readily manipulated by the thumb of the user. Through appropriate fore and aft movement of the convenient tab, one-handed control of the rotation and operative action of the wrench is afforded.

2 Claims, 5 Drawing Figures

RATCHET WRENCH ASSEMBLY

BACKGROUND OF THE INVENTION

The invention relates generally to ratchet wrenches, having a remotely actuated, reverse control mechanism for determining the operative mode of the wrench.

More specifically, the invention relates to a modification kit, or assembly designed primarily to retrofit existing ratchet wrenches, thereby providing remote control of the wrench reverse control mechanism from the handle end of the wrench.

DESCRIPTION OF THE PRIOR ART

Most ratchet wrenches include a small reverse control knob, usually located near the head end of the wrench. The control knob is movable into alternate rotational positions for determining the operative mode of the wrench. That is to say, the control knob determines whether the wrench is effective for levered clockwise or counter-clockwise rotation of the attached socket, or other work tool. For work in quarters which are confined or difficult to access, manipulation of the ratchet's reverse control knob may be very difficult, if not impossible. In recognition of this problem, ratchet wrenches have been developed which include a manipulable member on the handle, or grasping portion of the wrench, allowing one-handed rotation and mode control of the ratchet wrench.

U.S. Pat. No. 3,608,402, issued to Rainey, discloses a ratchet control mechanism, generally located within the shank, or lever arm of the wrench. Accordingly, the Rainey device requires the use of a tubular member for the shank portion of the wrench. Rantanen's reversible ratchet wrench, disclosed in U.S. Pat. No. 4,308,769, similarly employs a hollow wrench body for housing the reverse control mechanism. For a given shank diameter, it is not believed that the hollow shank wrenches in Rainey and Rantanen compare favorably, in overall strength, to the more conventional solid shank wrench designs.

Neither the Rainey nor the Rantanen device is adaptable to an existing conventional ratchet wrench, for the remote control mechanism is structurally integrated within the hollow shank, and useful solely with the particular reverse control mechanism therein.

Thus, while the need has been recognized for a handle controlled, reversible ratchet wrench, the known prior art has accomplished this end by compromising the strength of the wrench shank. Furthermore, owing to their inherent construction, the known designs cannot be adapted to modify, or retrofit, existing wrenches of conventional design.

SUMMARY OF THE INVENTION

The device herein is primarily intended to retrofit, or modify, an existing solid shank ratchet wrench to provide remote control of the reverse control mechanism from the handle end of the wrench. As an initial step, the reverse control knob of the existing wrench is either replaced, or modified, for crank drive. To that end, a crank pin is provided at the outer, peripheral portion of the modified control knob employed herein.

A control rod is mounted for fore and aft reciprocating movement along the shank, or lever arm, of the wrench, and extends from the crank pin to the handle end of the wrench. The middle portion of the control rod is preferably confined by means of a semi-flexible wire coil, through which the control rod is axially translated. The wire coil, in turn, is held securely against and along the shank by an elongated sheath, which clips over three sides of the shank.

At the handle end of the control rod, a thumb tab is provided adjacent the area where the user's thumb would normally grip the wrench. The tab is constructed slidingly to engage the handle end of the sheath, which acts further to prevent the coil and rod assembly from shifting laterally. By appropriate thumb manipulation of the tab, the reverse control knob is rotated from one extreme position to the other, and the wrench's mode of operation is thereby determined.

The design retains the desirable strength afforded by a solid shank construction, and allows retrofit, rather than replacement, of existing wrenches, where the remote control feature is desired.

DETAILED DESCRIPTION OF THE PREFERRED EMBODIMENT

Figure 1:
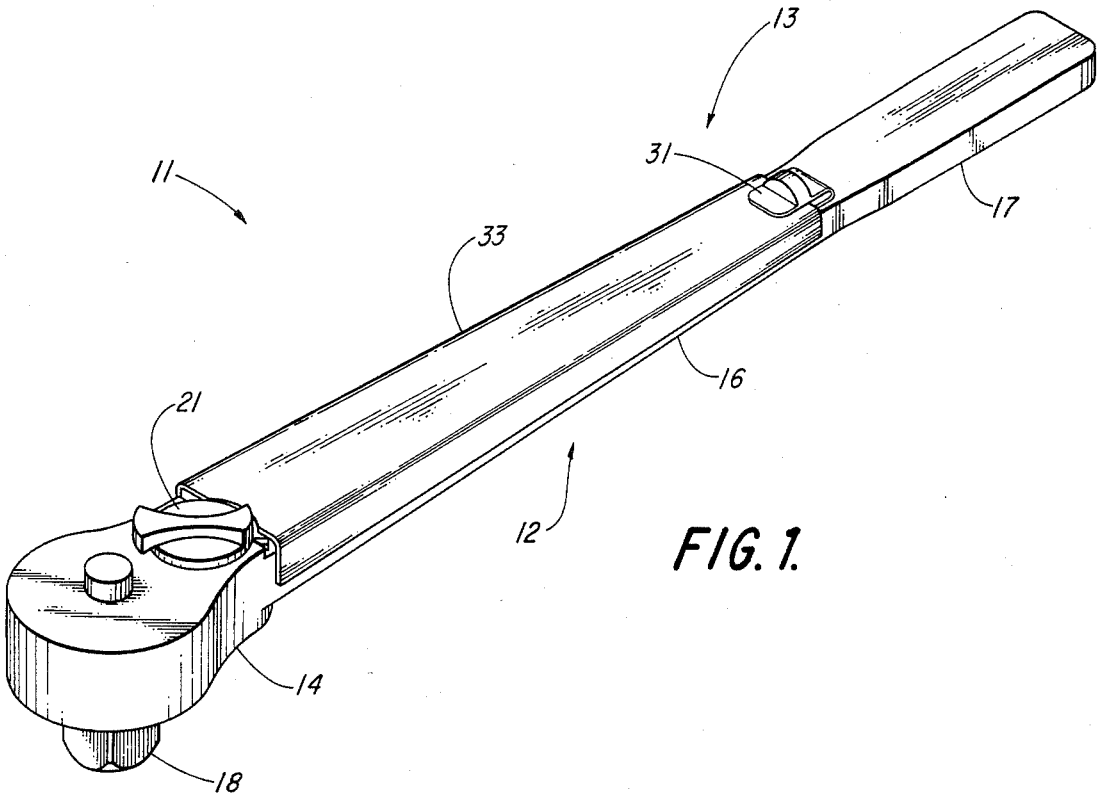
FIG. 1 is an isometric perspective taken from the head end of the ratchet wrench assembly of present design.
Figure 2:
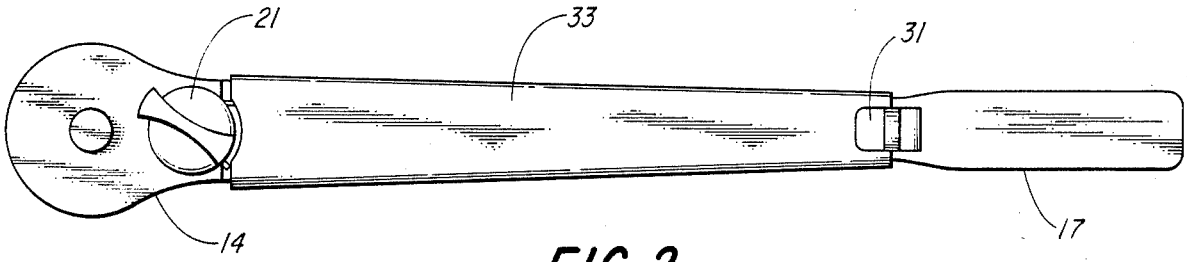
FIG. 2 is a top plan view, showing the reverse control knob in a first rotational position.

Turning now to FIG. 1, the combination 11 generally of the invention comprises a ratchet wrench body assembly generally designated 12 and a remote control assembly generally designated 13. Preferably constructed from a single piece of metal to ensure maximum strength, the body portion of the assembly 12 includes a head 14, a shank 16, and a handle 17. Protruding from the lower side of the head 14 is a socket stud 18, adapted to engage the particular set of sockets or extension rods, or other work tools on hand.

Since the details and particular design of ratchet wrench mechanisms are varied, and not generally of importance herein, no details of those mechanisms need to be shown or explained. It is sufficient to acknowledge that the combination 11 of the invention deals with that class of ratchets having a mode control member 19 (see FIG. 5) on or within the head 14 of the wrench. The mode control member 19 can assume any number of configurations, but operationally is movable into alternate rotational positions for determining the operative mode of the ratchet wrench. In other words, depending upon one or the other rotational positions of the member 19, the wrench will be effective to rotate the socket or other work tool in either a clockwise or a counter-clockwise direction.

Usually, for ease of manufacture and to afford a degree of protection for the ratchet's interworkings, a readily accessible reverse control knob 21 is provided to engage and manipulate the underlying mode control member 19. It is an object of the present invention only to require a simple modification or replacement of this reverse control knob 21 as the initial step in converting a conventional wrench to include the remote control feature. The standard reverse control knob 21 is either modified or replaced to function as a crank 21 by adding a crank pin 22 adjacent the outer edge or periphery of the knob 21. A D-shaped recess 23 is also provided in the knob 21 around the crank pin 22 to accommodate the end of a control rod 24, in a manner to be explained more fully herein.

The lower surface of the control knob 21 includes an elongated protuberance (not shown) which engages a similarly sized and shaped slot 26 in the upper surface of the mode control member 19. In this manner, rotational forces applied to the control knob 21 are directly transferred to act upon the mode control member 19.

Figure 3:
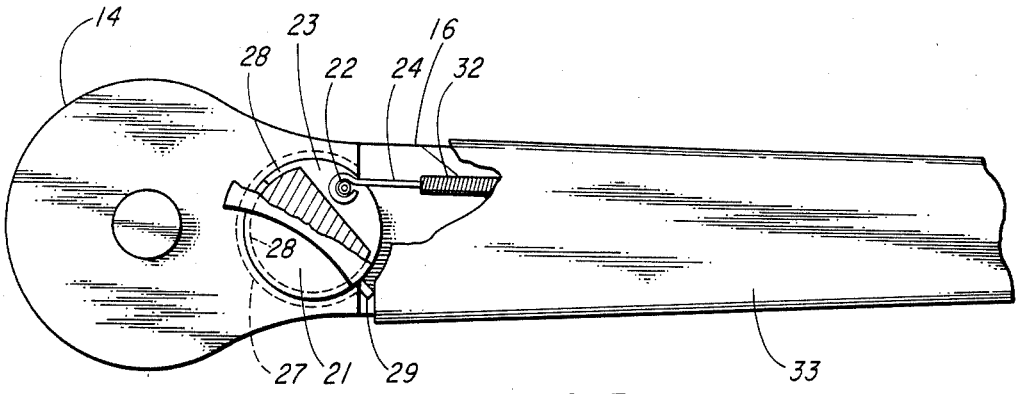
FIG. 3 is a top plan view taken to an enlarged scale, with portions of the reverse control knob and the sheath being broken away to reveal the crank pin and control rod interconnection.
Figure 5:
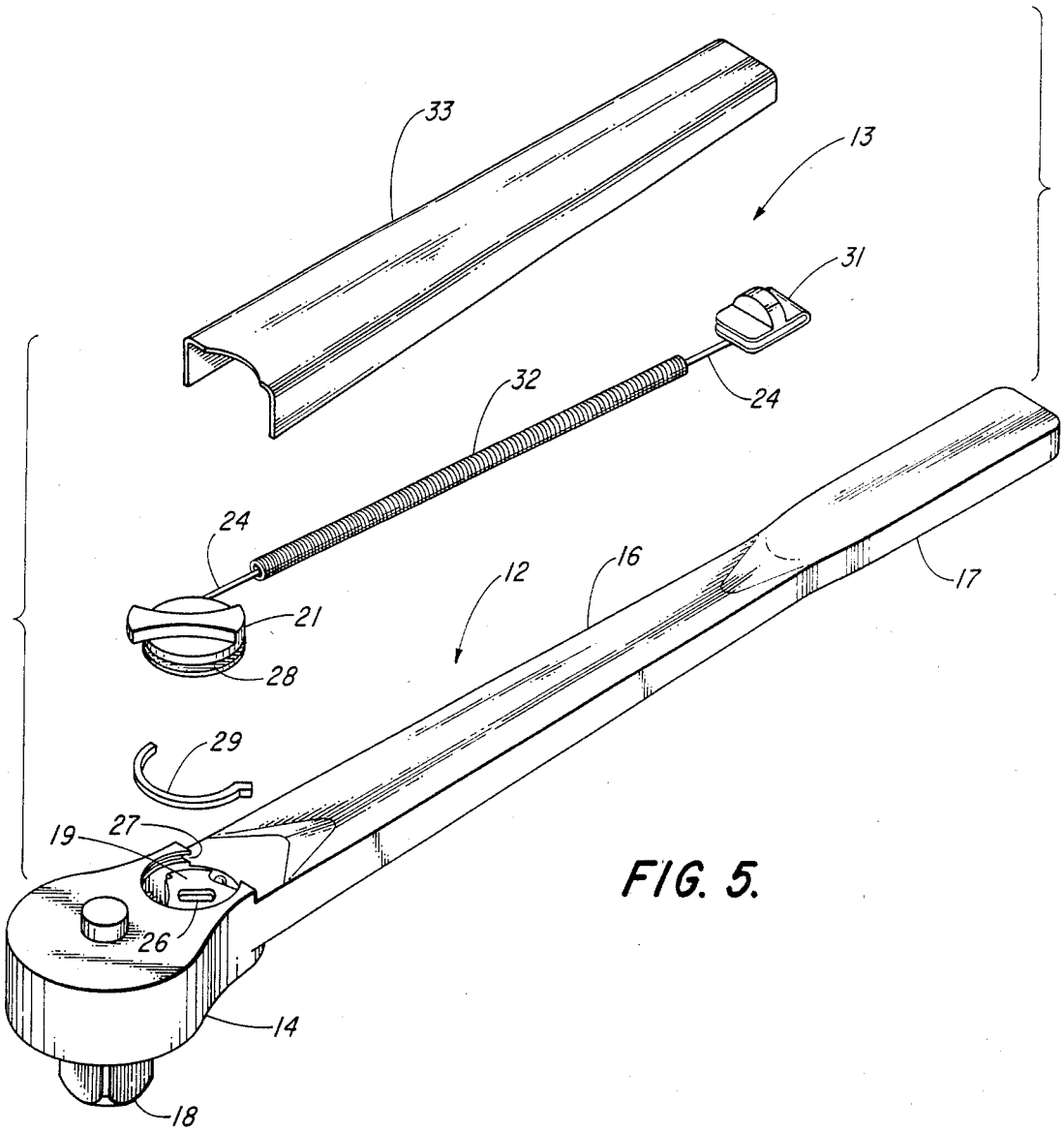

The portion of the head 14 immediately surrounding the control knob 21 includes an annular recess 27 (see FIGS. 3 and 5). An adjacent portion of the control knob 21 is provided with a peripheral groove 28. Spanning and filling a substantial portion of the volume defined by the recess 27 and the groove 28 is a semi-circular locking ring 29. The locking ring 29 maintains the control knob 21 securely within the head 14 while allowing free rotation of the control knob 21 for determining the operational mode of the combination 11.

The control rod 24 extends from the head end, where it is journaled on to the crank pin 22, to the handle end 17, where it is terminated in a thumb tab 31. The intermediate portion of the control rod 24 passes through a shroud 32 of semi-flexible coiled wire. An elongated sheath 33 is configured to define a space by overlying the face of the shank 16 and to clip over the side walls of the shank 16, confining the shroud 32 tightly along the face of the shank 16. However, the control rod 24, slidable within the coiled wire shroud 32, is free to be moved in a fore and aft, reciprocating fashion as dictated by manipulation of the thumb tab 31.

The body of the thumb tab 31 is U-shaped to slide over the adjacent end portion of the sheath 33 (see FIGS. 1 and 5). The length of the U-shaped portion of the tab 31 is such that regardless of the tab's fore or aft position, the end of the sheath 33 remains engaged by the tab 31. Consequently, the sliding engagement of the tab 31 with the sheath 33 acts laterally to confine and guide the adjacent end part of the control rod 24.

FIG. 3 illustrates a first rotational position of the control knob 21 in which the combination 11 is effective to apply clockwise rotational torque through the socket stud 18. The first rotational position of the knob 21 corresponds to an extreme rearward, or aft position of the control rod 24 and the thumb tab 31.

Figure 4:
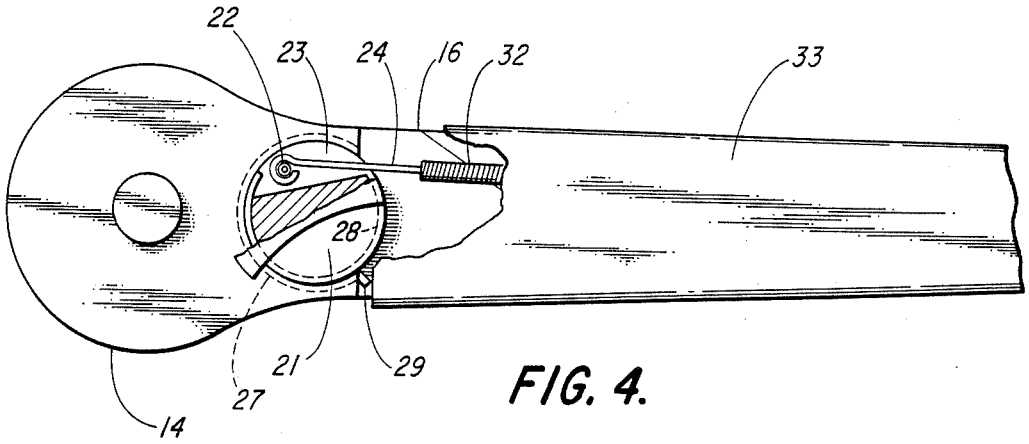
FIG. 4 is a top plan view as in FIG. 3, but with the reverse control knob in a second rotational position; and, FIG. 5 is an exploded isometric perspective, showing the remote control assembly, the locking ring and the ratchet mode control member.

In FIG. 4, the thumb tab 31 and control rod 24 have been thrust into an extreme forward position, causing the control knob 21 to rotate into a second rotational position. The mode of operation of the combination 11 has now been changed to apply counter-clockwise rotational torque through the socket stud 18, as the handle 17 is grasped and rotated.

A comparison of FIGS. 3 and 4 reveals that the sheath 33 holds the coiled wire shroud 32 stationary while the control rod 24 shifts fore and aft. These Figures also illustrate that the recess 23 must be of sufficient size and of proper placement to allow the unimpeded motion of the control rod 24 relative to the body of the control knob 21, regardless of the rod's fore or aft position.

It will be appreciated that the control rod 24 can be secured along the shank 16 in a variety of ways other than the manner shown herein. For instance, the sheath 33 could be eliminated and the coiled wire shroud 32 or its equivalent structure could be attached directly and permanently to the shank 16. Also, the control rod 24 could be pivotally attached to the control knob 21 in a number of different ways, depending upon the exact construction of the pin 21 itself. It is further evident that the combination herein need not be applied solely as a retrofit assembly, and could just as readily be incorporated into a new ratchet wrench construction. All of these variations are considered obvious matters of design choice, and do not therefore diverge from the spirit of the invention herein.

I have provided, therefore, a simple and inexpensive assembly to retrofit an existing ratchet wrench and modify the same for remote control of the reverse control mechanism from the handle end of the wrench.

What is claimed is:

1. In a ratchet wrench having a shank with a face and side walls and with a handle at one end and a head at the other end and having in said head a socket stud adapted to rotate in either of two directions and having in said head means including a control knob movable into either of two positions in engagement with a pawl and ratchet means for correspondingly controlling the direction of rotation of said stud, the combination of a ratchet wrench assembly comprising a crank pin eccentrically mounted on and upstanding from said control knob, a sheet-like sheath in part clipped on said side walls of said shank and in part separated from said face of said shank to leave a space therebetween, a tubular shroud located within said space and confined against said shank face by said sheath, a thumb tab embracing one end of and slidably mounted on said sheath, a rod slidably mounted within said shroud, means at one end of said rod for securing said rod to said thumb tab, and means at the other end of said rod journalling the other end of said rod on said crank pin, wherein said thumb tab is for remotely and alternatively controlling the direction of rotation of said stud.

2. A device as in claim 1 in which said shroud at one end is substantially spaced from said pin to expose said rod therebetween.

* * * * *